US010456648B1

(12) United States Patent
Imahata

(10) Patent No.: US 10,456,648 B1
(45) Date of Patent: Oct. 29, 2019

(54) SWING PRACTICE APPARATUS

(71) Applicant: Takeo Imahata, Colfax, CA (US)

(72) Inventor: Takeo Imahata, Colfax, CA (US)

( * ) Notice: Subject to any disclaimer, the term of this patent is extended or adjusted under 35 U.S.C. 154(b) by 0 days.

(21) Appl. No.: 16/390,271

(22) Filed: Apr. 22, 2019

(51) Int. Cl.

| | |
|---|---|
| ***A63B 69/00*** | (2006.01) |
| *A63B 102/02* | (2015.01) |
| *A63B 102/18* | (2015.01) |
| *A63B 102/32* | (2015.01) |

(52) U.S. Cl.
CPC ..... *A63B 69/0079* (2013.01); *A63B 69/0002* (2013.01); *A63B 2069/0008* (2013.01); *A63B 2102/02* (2015.10); *A63B 2102/18* (2015.10); *A63B 2102/32* (2015.10); *A63B 2225/093* (2013.01)

(58) Field of Classification Search
CPC ..... A63B 69/0079; A63B 2102/32; A63B 2069/0008; A63B 69/0002; A63B 2102/18; A63B 2102/02; A63B 2225/093; A63B 69/0091; A63B 69/0084
USPC ..... 473/422–430, 451, 417
See application file for complete search history.

(56) References Cited

U.S. PATENT DOCUMENTS

| | | | | |
|---|---|---|---|---|
| 1,907,412 | A * | 5/1933 | Zimmer | A63B 69/0024 473/144 |
| 3,086,775 | A * | 4/1963 | Albert | A63B 69/0084 473/428 |
| 3,630,521 | A | 12/1971 | Lingbeek | |
| 3,924,855 | A * | 12/1975 | Pretorius | A63B 69/0084 473/575 |
| 4,342,459 | A * | 8/1982 | Pretorius | A63B 69/0084 256/38 |
| 4,944,513 | A | 7/1990 | Zentner | |
| 5,413,347 | A * | 5/1995 | Prater | A63B 69/0084 473/147 |
| 5,611,539 | A * | 3/1997 | Watterson | A63B 61/02 273/400 |
| 6,334,821 | B1 * | 1/2002 | Kita | A63B 69/0079 473/422 |
| 9,889,360 | B1 | 2/2018 | Wilson | |

* cited by examiner

*Primary Examiner* — Nini F Legesse
(74) *Attorney, Agent, or Firm* — Muramatsu & Associates

(57) ABSTRACT

A swing practice apparatus has a base portion that makes a contact on a ground, a standing pole that extends upward vertically from the base portion, a horizontal arm that is elongated between a first base side and a third base side and is arranged to be perpendicular to the standing pole, a hinged arm that is rotatable at one end at a middle of the horizontal arm, a trajectory pipe attached to the other end of the hinged arm, a trajectory wire connected between the trajectory pipe and a bracing structure, and a ball suspended to a suspension ring which is slidable along the trajectory wire and the trajectory pipe.

8 Claims, 12 Drawing Sheets

SWING PRACTICE APPARATUS

FIELD OF THE INVENTION

This invention relates to a swing practice apparatus, and more particularly to a swing practice apparatus for baseball, tennis, golf etc., that allows a user to continuously hit a ball for swing practice.

BACKGROUND OF THE INVENTION

Sport players, such as baseball players, tennis players, etc., would like to have the opportunity for more frequent practice in developing a proper stroke with use of a bat or a racket, etc. Since hitting a baseball results in the baseball traveling an extended distance, baseball players often go to a facility such as a baseball practice range to practice their stroke, which is inconvenient for reasons such as the time required to get there, delays due to increased overcrowding, and the cost of using the facility.

Various devices have been developed which hold the baseball at a predetermined initial position to be hit by a baseball bat. For efficient practicing of swings, it is desired that the user is able to practice continuously. It is further desired that the user is able to acquire a good sense of timing for hitting the ball. It is further desired that those functionalities be achieved with a simple structure to reduce cost and improve reliability.

SUMMARY OF THE INVENTION

It is, therefore, an object of the present invention to provide a swing practice apparatus that is reliable and low cost with a simple structure that enables the user to practice swing of a bat, racket, golf club, or any other instrument to hit a ball repeatedly.

The swing practice apparatus of the present invention includes: a base portion that makes a contact on a ground; a winding roller having an attaching mechanism; a trajectory wire, one end of which is connected to the attaching mechanism of the winding roller, and the other end of which is connected to a bracing structure; a standing pole that extends upward vertically from the base portion; a horizontal arm that is elongated between a first base side and a third base side and is arranged to be perpendicular to the standing pole; a pair of horizontal arm wire guide pulleys, having grooves, attached side by side at a middle of the horizontal arm, to receive the trajectory wire in the grooves; a hinged arm that is rotatable at one end by a hinge at a middle of the horizontal arm; a hinged arm wire guide pulley attached at an end of the hinged arm opposite to the middle of the horizontal arm; a trajectory wire hole formed at the end of the hinged arm where the hinged arm wire guide pulley is positioned and the trajectory wire hole is adapted to allow passage of the trajectory wire; a trajectory pipe, one end of which is connected to the hinged arm at the trajectory wire hole, and the other end is extended toward a pitcher side and has a peak hole at its terminal end adapted to allow passage of the trajectory wire; and a ball suspended to a suspension ring and the suspension ring is slidable along the trajectory wire and the trajectory pipe.

The swing practice apparatus of the present invention further has the base portion comprising a base contact portion having a flat surface adopted to contact on a ground, and a prong portion provided at the bottom of the base contact portion and has a tapered end.

Another aspect of the disclosure is directed to the swing practice apparatus that further has a gear having a plurality of teeth, connected to the winding roller, and a stopper that has an end to engage with one of the plurality of teeth of the winding roller. The swing practice apparatus of the present invention further has a spring that exerts force to the stopper so that the end of the stopper is securely engaged to a tooth of the gear by being pushed toward the tooth. The swing practice apparatus of the present invention further has a handle attached to the gear for the user to manually rotate the gear and the winding roller to wind and unwind the trajectory wire.

In the swing practice apparatus of the present invention, the trajectory pipe may have a curved portion that simulates a curve ball or may have a straight shape.

In another aspect of the swing practice apparatus of the present invention, an upper portion may be comprised of a vertical bar connected to the horizontal arm and the hinged arm, the horizontal arm that is attached perpendicularly to the vertical bar; and the hinged arm, and that the vertical bar is elongated vertically and has a plurality of fixing holes and the standing pole has plurality of positioning holes, and the fixing holes and the positioning holes are adapted to be connected by being inserted by a screw. These and other aspects and implementations are discussed in detail below.

DETAILED DESCRIPTION OF THE PREFERRED EMBODIMENTS

Figure 1:
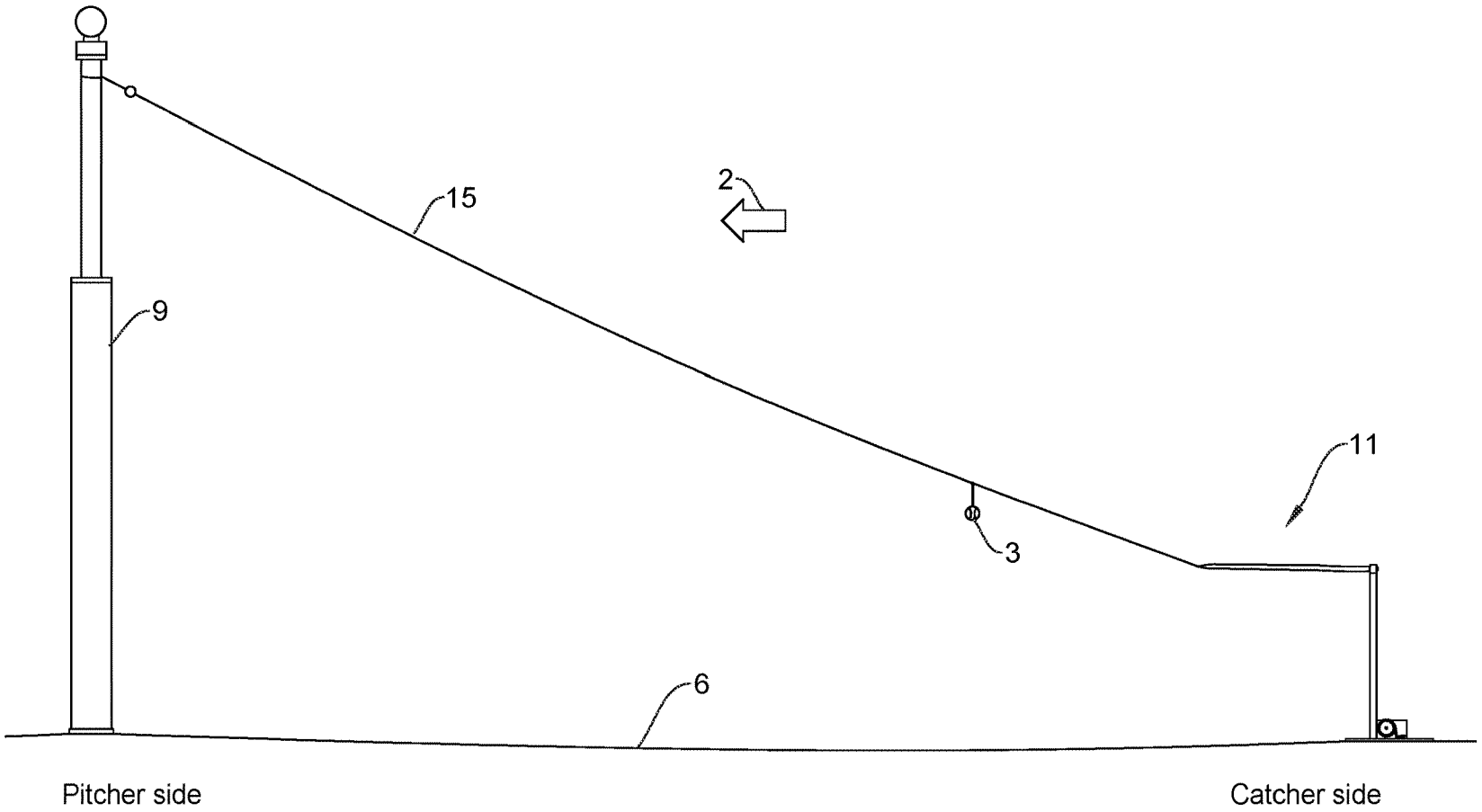
FIG. 1 is a side view showing a swing practice apparatus of the present invention where a baseball is suspended to a trajectory wire and the trajectory wire is tied to a bracing structure.

The present invention will be described in detail with reference to the accompanying drawings. FIG. 1 is a side view showing a swing practice apparatus 11 of the present invention where a baseball 3 is suspended to a trajectory wire 15. While the baseball 3 is used throughout the specification, other types of balls may also be used in the swing practice apparatus 11 of the present invention. One end of the trajectory wire 15 is connected to a pole 9 and the other end is connected to the swing practice apparatus 11. The pole 9 and the swing practice apparatus 11 stand on the ground 6. While the pole 9 is used in this embodiment shown in FIG. 1, other structures or trees may also be used instead of the pole 9 for the purpose of connecting the trajectory wire 15 of the swing practice apparatus. The structure to which the the trajectory wire 15 from the swing practice apparatus is connected is referred to as a bracing structure. The height at which the trajectory wire 15 is tied (tied height) to the pole 9 is higher than the standing height of the swing practice apparatus 11. The baseball 3 slides down along the trajectory wire 15 due to gravity such that the user is able to hit the baseball 3. The higher the tied height, the steeper the incline angle of the trajectory wire 15 becomes. Thus, the higher the tied height, the faster the baseball 3 coming from the side of the pole 9. Accordingly, the tied height can be adjusted based on the user's preference. The user may set a steeper incline angle if it is desired that the baseball 3 coming from the side of the pole 9 be faster. In a preferred embodiment, the the incline angle of the trajectory wire 15 is between 20 to 40 degrees.

A user (not shown in FIG. 1) is positioned near the swing practice apparatus 11 to hit the baseball 3. While the baseball 3 is used throughout the specification, other balls suited for other sports, such as tennis or cricket, may also be used for the swing practice apparatus 11 of the present invention to hit the ball by a racket, etc. Further more, it is also possible to use the swing practice apparatus 11 of the present invention to hit a stationary ball, such as a golf ball. An arrow 2 in FIG. 1 indicates the direction to which the baseball will be hit. In the side view shown in FIG. 1, the user hits the baseball to the left direction, which is where the pole 9 (bracing structure) is located. The side toward which the baseball is hit is referred to as a pitcher side, which corresponds to the left side in FIG. 1. The opposing side of the pitcher side is referred to as a catcher side, which corresponds to the right side in FIG. 1.

Figure 2:
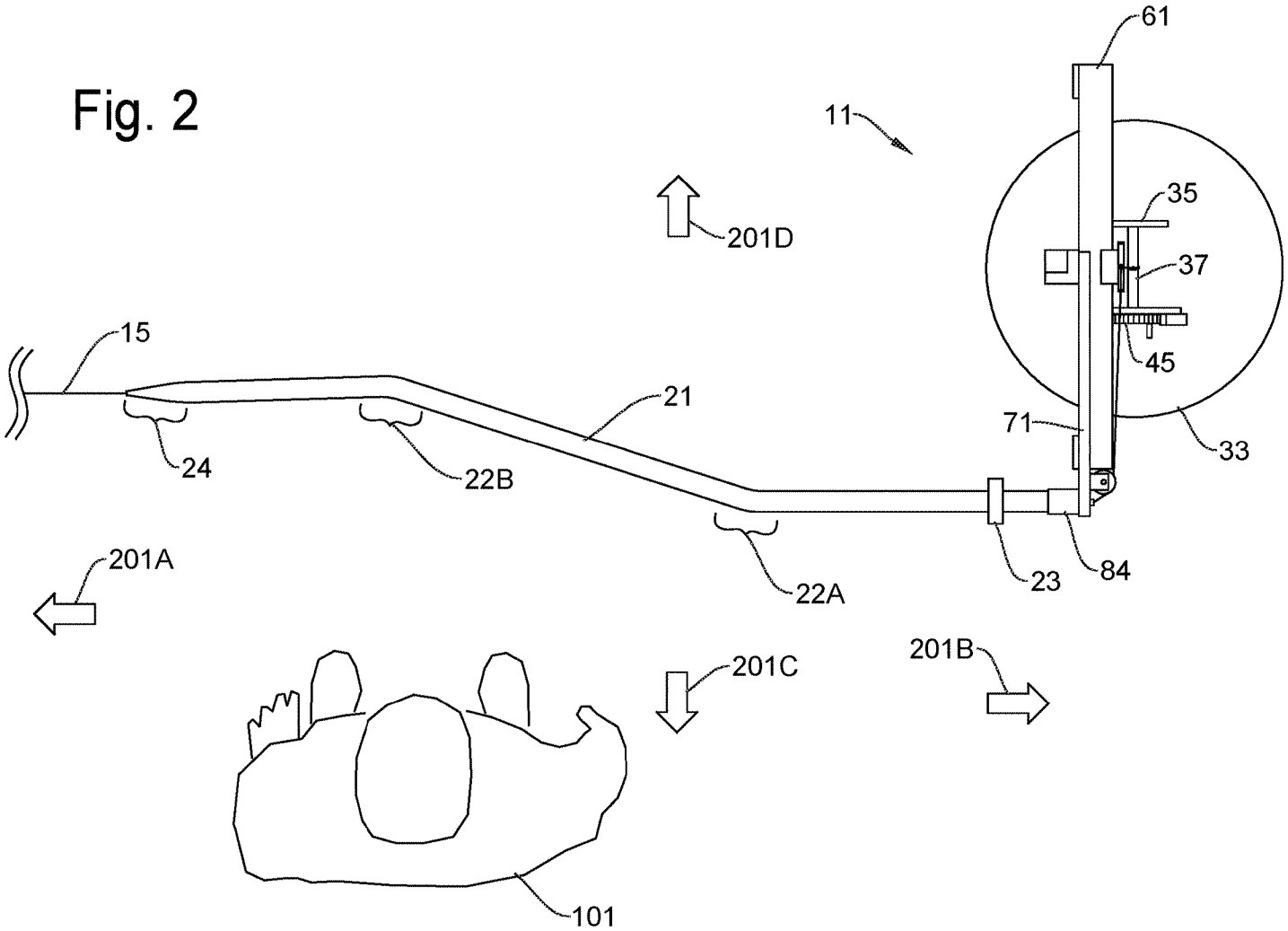
FIG. 2 is a top view showing the swing practice apparatus of the present invention in relation with a position of a user in practice.

FIG. 2 is a top view showing the swing practice apparatus 11 in more detail and the user 101 standing next to the swing practice apparatus 11. Four arrows 201A, 201B, 201C and 201D are shown in FIG. 2 for the purpose of describing directional relationships of components of the swing practice apparatus 11. Arrow 201A indicates a direction to which the baseball 3 is to be hit by a baseball, and is referred to as the pitcher side direction. The direction indicated by arrow 201A is equivalent to the direction indicated by arrow 2 in FIG. 1. Referring back to FIG. 2, arrow 201B indicates a direction to which a catcher would be positioned in a real baseball game, and is referred to as the catcher side direction. Arrow 201C indicates a direction to which a third base is located and is referred to as the third base side direction. Arrow 201D indicates a direction to which a first base is located and is referred to as the first base side direction.

In this embodiment example, the user 101 is a batter who wants to hit a the baseball 3 with a baseball bat. A trajectory pipe 21 extends to the pitcher side direction. In this example, the user 101 is a right-handed batter positioned at the third base side. The trajectory wire 15 extends from an end of the trajectory pipe 21 of the swing practice apparatus 11, and is extended toward the pitcher side direction to be tied to the bracing structure (pole 9) shown in FIG. 1. The tip of the trajectory pipe 21 is tapered and has a hole at its distal end for the trajectory wire 15 to pass through, which will be described later in detail with reference to FIG. 11A.

The trajectory pipe 21 is a pipe that has inner hollow space that allows passage for the trajectory wire 15. A stopper 23 may be attached to a cather side of the swing practice apparatus 11. The stopper 23 is an apparatus to stop the suspended baseball 3. The trajectory wire 15 exits from a hole of the trajectory pipe 21 opposite to the tapered end of the trajectory pipe 21 and is guided to a winding mechanism of the swing practice apparatus 11.

The swing practice apparatus 11 as shown in FIG. 2 has a horizontal arm 61, a base contact portion 33, a gear 45, winding support walls 35, a winding roller 37, and a hinged arm 71. The horizontal arm 61 is elongated in the direction between the first base side and the third base side. The trajectory pipe 21 has a peak portion 24. The tip (terminal end) of the peak portion 24 is provided with a small hole for the trajectory wire 15 to pass through as will be described later with reference to FIG. 11A. The trajectory wire 15 that exits from the small hole of the peak portion 24 extends toward the pole 9 to be tied at a desired position of the pole 9.

Figure 3:
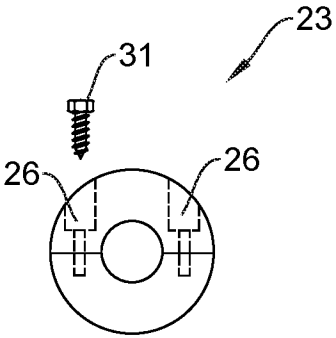
FIG. 3 is an illustration of a stopper that can be used in the swing practice apparatus of the present invention to stop the suspended ball at a fixed location.

FIG. 3 is an illustration of the stopper 23 for the swing practice apparatus 11 of the present invention. As shown in FIG. 2, the stopper 23 is attached to the trajectory pipe 21 of the swing practice apparatus 11. The stopper 23 is comprised of an upper and lower portions that are attached with each other by means of a screw 31. The screw 31 is inserted to a screw hole 24 shown by dotted lines to securely attach the stopper 23 to the trajectory pipe 21. The inner circumference of the stopper 23 is designed to match the outer circumference of the trajectory pipe 21 so that when the stopper 23 is attached to the trajectory pipe 21, the stopper 23 is securely fixed and work as a stopper to stop a suspending ring 29 (not shown in FIG. 3) that moves to the catcher's side of the swing practice apparatus 11.

Figure 4B:
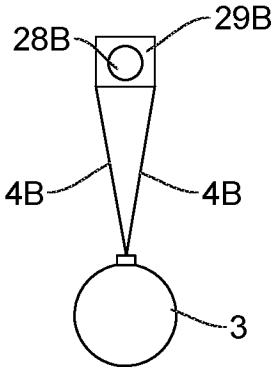
FIG. 4B is an illustration similar to that shown in FIG. 4A, except that the suspending strings are used and and the ring is in a different configuration.
Figure 4A:
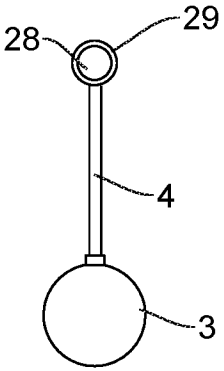
FIG. 4A is an illustration of a baseball, a suspending strap, and a ring to be used in the swing practice of the present invention.

FIG. 4A is an illustration of the baseball 3, the suspension ring 29, and a suspension strap 4 to be used for the swing practice apparatus 11 of the present invention. The suspension strap 4 is connected to the baseball 3 and to the suspension ring 29. The suspension ring 29 is passed through the trajectory wire 15. The inner circumference 28 of the suspension ring 29 is large enough to pass through the the trajectory wire and the trajectory pipe 21. The suspension cord 4 is preferably made of durable material, such as woven nylon strap. As shown in FIG. 1, the ball 3 suspended by the suspension strap is freely movable along the trajectory wire 15 via the suspension ring 29.

FIG. 4B is an illustration similar to that in FIG. 4A, except that a suspension ring 29B that has a rectangular perimeter and the suspension strings 4B made of wire suspend the baseball 3 by being connected at both ends of the suspension ring 29B. The inner circumference 28B is larger than the outer circumference of the trajectory pipe 21. Other configurations may also be utilized to suspend the baseball 3.

Referring back to FIG. 2, the peak portion 24 has a tapered end. The shape of the peak portion 24 allows smooth entry of the suspension ring 29 into the trajectory pipe 21 when the baseball 3 moves from the pitcher side to the catcher side. The suspension ring 29 that slides down along the trajectory wire 15 passes the peak portion 24 and then passes through a curved portion 22B of the trajectory pipe 21. If the user 101 does not hit the baseball 3, the suspension ring 29 passes through a curved portion 22A and hits the stopper 23 to be stopped.

The curved portion 22B is a bent portion of the trajectory pipe 21 and allows the user to simulate a desired ball trajectory, such as a curve ball. The degree of the curve of the curved portion 22A may take various degrees, for example, between 10 to 30 degrees. When the user wishes an intense trajectory change, the curved portion 22A may be more angled to have a higher degree of the curve. While the trajectory pipe 21 shown in FIG. 2 has two curved portions 22A and 22B, the trajectory pipe 21 may have more curved portions, such as three. Further, the trajectory pipe 21 may take a configuration that extends straight without any curve. The length of the trajectory pipe 21 is preferably between 1 to 3 meters, while it may take other length to suit the need of the user.

Figure 5B:
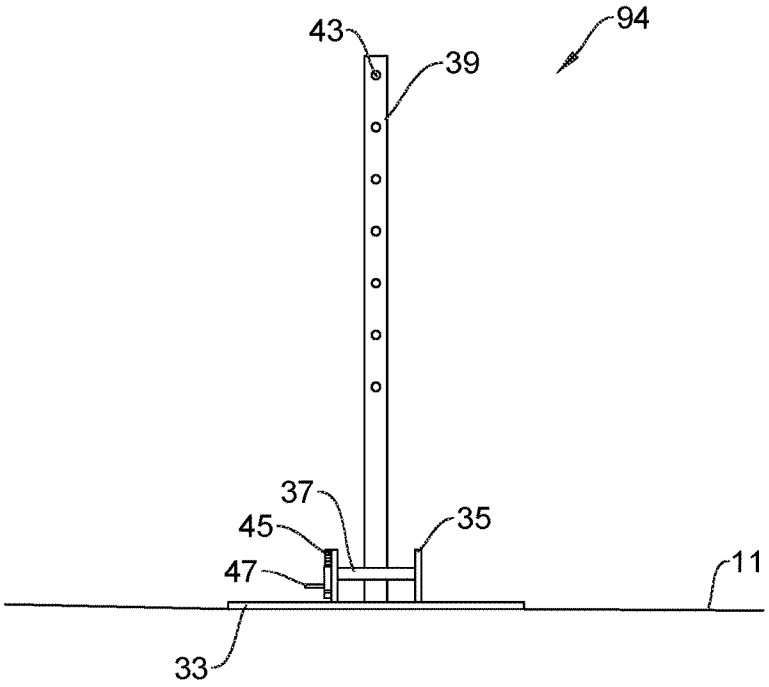
FIG. 5B is an illustration similar to that shown in FIG. 5A, except that a prong portion of the base portion is placed into the ground.
Figure 5A:
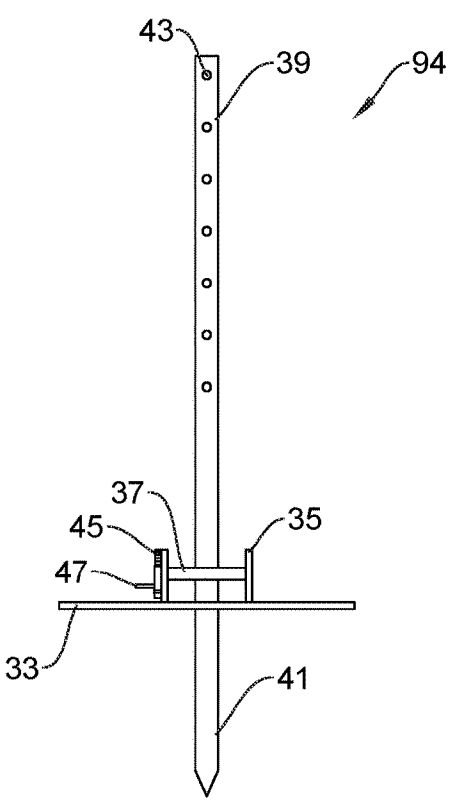
FIG. 5A is an illustration of a base portion of the swing practice apparatus of the present invention.

FIG. 5A is a front view of a lower portion 94 of the swing practice apparatus 11 of the present invention, which corresponds to the pitcher side direction 201A shown in FIG. 2. The lower portion 94 refers to the group of components comprising the lower portion of the swing practice apparatus 11. The lower portion 94 has a standing pole 39 that stands vertically. The standing pole 39 has a plurality of positioning holes 43 that is aligned vertically along the elongated direction of the standing pole 39. The positioning holes 43 are used to attach an upper portion 92 (shown in FIG. 7) to the lower portion 94. The base contact portion 33 has a flat surface and is designed to contact on the ground. A prong portion 41 provided at the bottom of the base contact portion 33 has a tapered end that is suitable for pronging into the ground. The length of the prong portion 41 can be adapted to conditions for which the swing practice apparatus 11 is used. In a preferred embodiment, the length of the prong portion 41 is between 20 to 50 centimeters. The prong portion 41 and the base contact portion 33 make up a base portion that works to securely fix the swing practice apparatus 11 of the present invention to the ground.

FIG. 5B is a front view of the lower portion 94 similar to that shown in FIG. 5A, except that the prong portion 41 (not shown in FIG. 5B) is pronged into the ground 6. The flat bottom surface of the base contact portion 33 makes contact with the ground 11. Due to the prong portion 41 stabbed into the ground 6 and the base contact portion 33 that contacts the ground 6, the lower portion 94 can be securely fixed to the ground 6. The configuration of the base portion comprising the prong portion 41 and the base contact portion 33 can be varied depending on the environment in which the swing practice apparatus 11 is used. For example, the base portion may have multiple prong portions 41 that extends downward from the base contact portion 33.

Figure 6B:
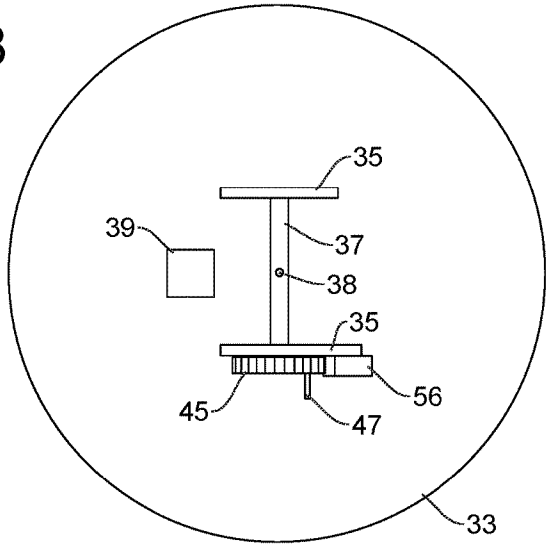
FIG. 6B is a top view of the the base portion of the swing practice apparatus of the present invention.
Figure 6C:
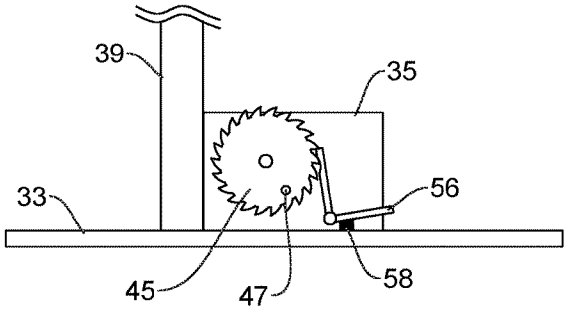
FIG. 6C is a side view of the the base portion of the swing practice apparatus of the present invention.
Figure 6A:
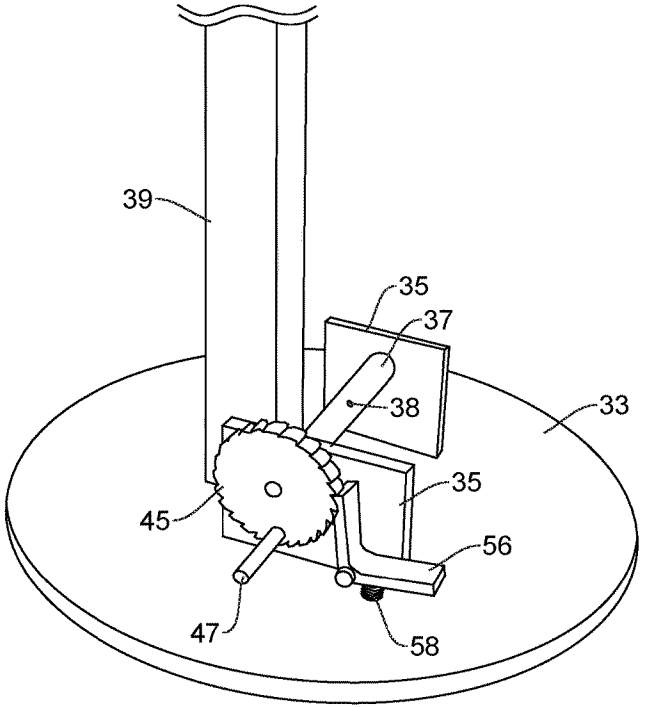
FIG. 6A is a perspective view of a part of the base portion of the swing practice apparatus of the present invention.

FIG. 6A to FIG. 6C illustrate a lower part of the lower portion 97 of the swing practice apparatus 11 of the present invention. The lower portion 97 illustrated in FIG. 6A to FIG. 6C shows the condition wherein the prong portion 41 shown in FIG. 5A is pronged into the ground, and therefore, the prong portion 41 is not shown in the drawings in FIG. 6A to FIG. 6C.

FIG. 6A is a perspective view of a lower part of the lower portion 97 of the swing practice apparatus 11 of the present invention. The standing pole 39 extends upward from the base contact portion 33. The base contact portion 33 has a disk shape, or a circular shape as seen from the top, to provide enough contact area to the ground when the swing practice apparatus 11 is placed on the ground. The winding support walls 35 stand on the base contact portion to be opposite with each other. The winding roller 37 is supported by the winding support walls 35 to be rotatable. The gear 45 is connected to the winding roller 37 so that the rotation of the winding roller 37 is coupled to the gear 45. The gear 45 is attached with a handle 47, which extends outwardly from the gear 45, to allow the user to easily rotate by hand the gear 45 and the winding roller 37, thereby winding or unwinding the trajectory wire 15.

The gear 45 has plurality of teeth that is engaged with a stopper 56. The stopper 56 is an L-shaped apparatus that is swingablely connected at one of the winding support walls 35. One end of the stopper 56 is adapted to engage with one of the teeth of the gear 45. A spring 58 provides force to the stopper 56 so that the end of the stopper 56 is securely engaged to the tooth of the gear 45 by being pushed toward the tooth. The winding roller 37 has a winding wire hole 38, which functions as an attachment mechanism, into which an end of the trajectory wire 15 is inserted. The user is able to rotate the winding roller 37 by rotating the handle 47, thereby winding the trajectory wire 15 to the winding roller 37. The winding roller 37 may have other types of attachment mechanism to attach the trajectory wire 15. For example, a hook may be provided as the attachment mechanism instead of the winding wire hole 38 to attach the trajectory wire 15 to the winding roller 37. The other end of the trajectory wire 15 is connected to the pole 9 (bracing structure) as shown in FIG. 1.

FIG. 6B is a top view of a lower part of the lower portion 97 of the swing practice apparatus 11 of the present invention. The base contact portion 33 is a circular-shaped portion that makes contact with the ground. In a preferred embodiment, the radius of the base contact portion 33 is between 15 to 50 centimeters. The thickness of the base contact portion 33 is preferably 0.5 to 2 centimeters. While the base contact portion 33 takes the shape of a circle, other shapes may also be utilized, such as a square. FIG. 6C is a side view of a lower part of the lower portion 97 of the swing practice apparatus 11 of the present invention. The gear 45 has a plurality of teeth that are designed to engage with the stopper 56. The spring 58 positioned on the base contact portion 33 pushes up the stopper so that an end of the stopper leans to the gear 45.

Figure 7:
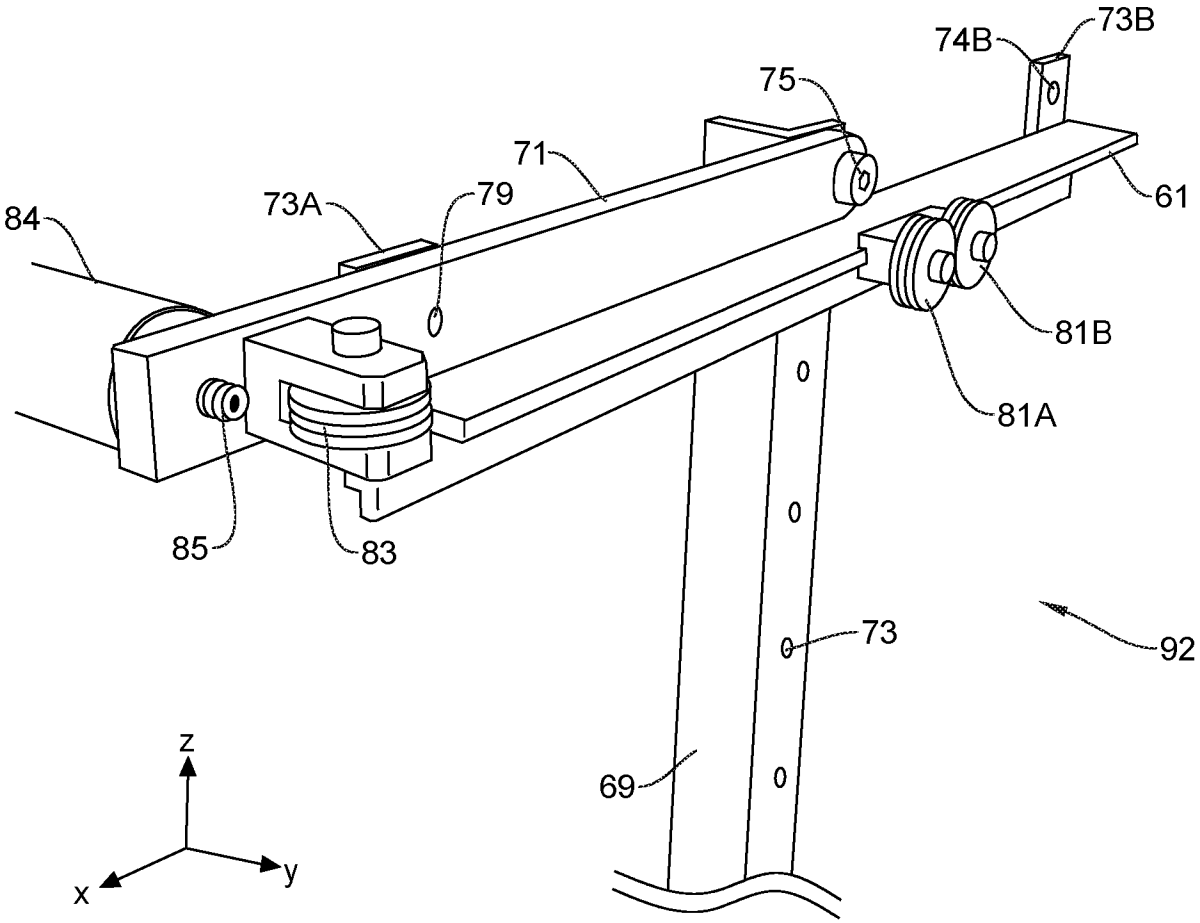
FIG. 7 is a perspective view of an upper portion of the swing practice apparatus of the present invention.
Figure 8A:
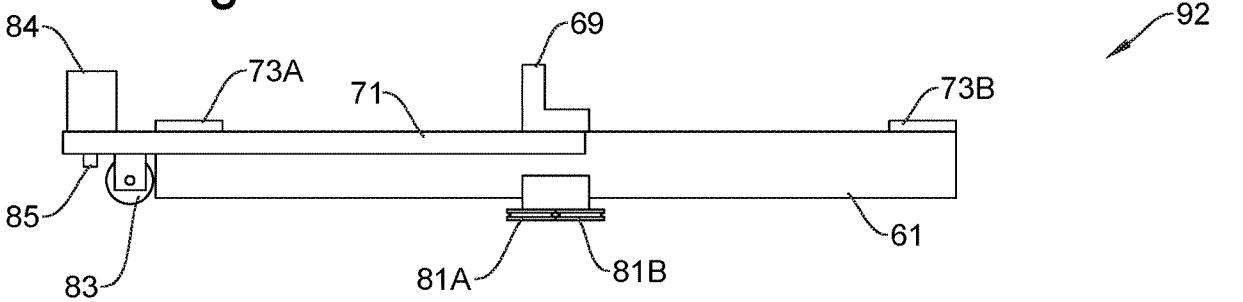
FIG. 8A is a top view of the upper portion of the swing practice apparatus of the present invention.
Figure 8B:
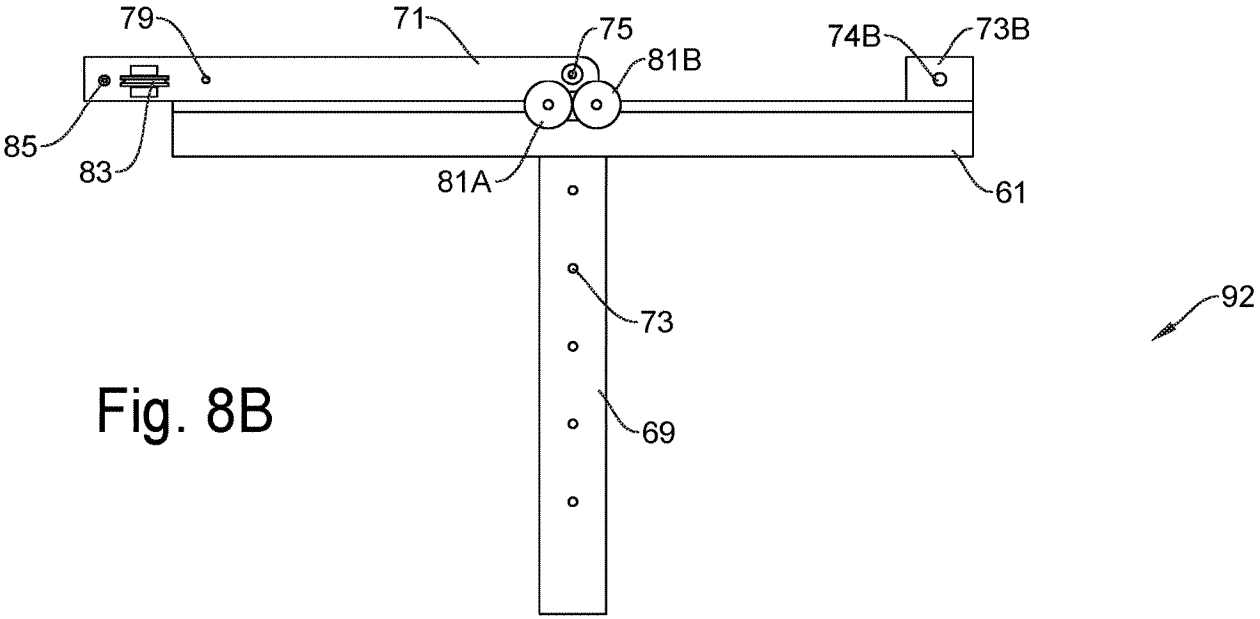
FIG. 8B is a front view of the upper portion of the swing practice apparatus of the present invention.

FIG. 7 is a perspective view of an upper portion 92 of the swing practice apparatus 11 of the present invention. At a left bottom area of FIG. 7, a three-dimensional Cartesian coordinate is illustrated to describe directional relationships of the swing practice apparatus 11. The three-dimensional Cartesian coordinate shows X, Y and Z coordinates. The upper portion 92 mainly comprises a vertical bar 69, the horizontal arm 61 and the hinged arm 71. FIG. 8A is a top view of the upper portion 92 of the swing practice apparatus 11 of the present invention. FIG. 8B is a side view of the upper portion 92 of the swing practice apparatus 11 of the present invention. Referring back to FIG. 7, the upper portion 92 has the vertical bar 69 that has a plurality of fixing holes 73 along the vertical bar 69. The vertical bar 69 extends along the z-coordinate. The fixing holes 73 are screw holes that are designed to be positioned to corresponding positioning holes 43 that are provided along the standing pole 39 of the lower portion 94 shown in FIG. 5A and FIG. 5B. A screw (not shown) is inserted to penetrate both the fixing hole 73 of the upper portion 92 and the positioning hole 43 of the lower portion 94 to securely attach the upper portion 92 to the lower portion 94 at a desired height. As a result, the vertical bar 69 is extended vertically upward from the standing pole 39.

The horizontal arm 61 extends along the x-coordinate, and runs perpendicular to the vertical bar 69. A pair of horizontal arm wire guide pulley 81A positioned at the left and 81B positioned at the right is provided at a middle of the horizontal arm 61. The horizontal arm wire guide pulleys 81A and 81B are rotatable by y-axis and has a groove that is designed to receive the trajectory wire 15. The horizontal arm wire guide pulley 81A and the wire guide pulley 81B are arranged side by side to receive the trajectory wire 15 by the grooves of both of the horizontal arm wire guide pulleys 81A and 81B. The trajectory wire 15 from the winding 37 is able to change its direction to either the first base side (arrow 201D in FIG. 2) or the third base side (arrow 201C in FIG. 2) as it passes the horizontal arm wire guide pulleys 81A and 81B.

The hinged arm 71 is positioned above the horizontal bar 61. The hinged arm 71 is designed to be capable of rotating at a hinged arm axis that is rotatably fixed by a hinge pin 75. A hinged arm wire guide pulley 83 is provided at the opposite end of the hinge pin 75 of the hinged arm 71. The hinged arm wire guide pulley 83 is rotatable by z-axis and has a groove that receives the trajectory wire 15. A trajectory wire hole 85 provided at the end of the hinged arm 71 is adapted to allow passage of the trajectory wire 15. The trajectory wire hole 85 is preferably located near the hinged arm wire guide pulley 83, for example, within 10 centimeter from the neardest edge of the hinged arm wire guide pulley 83.

At both sides of the horizontal arm 61 are provided with notches 73A positioned at the left and 73B positioned at the right. The notch 73A has a notch screw hole 74A that penetrates through the notch 73A. The notch 73B has a notch screw hole 74B that penetrates through the notch 73B. An arm fixture hole 79 is provided to the hinged arm 71 to correspond to either the notch screw hole 74A or the notch screw hole 74B.

An insertion slot 84 shown in FIG. 7 and FIG. 8A is an opening into which an end of the trajectory pipe 21 is inserted. In order to attach the trajectory pipe 21 securely into the insertion slot 84, an end portion of the trajectory pipe 21 and the inside of the insertion slot 84 may be threaded to correspond with each other. Alternatively, the trajectory pipe 21 may be simply snuggled into the insertion slot 84 and a pin (not shown) may be inserted to lock the trajectory pipe 21 at a fixed position.

Figure 9:
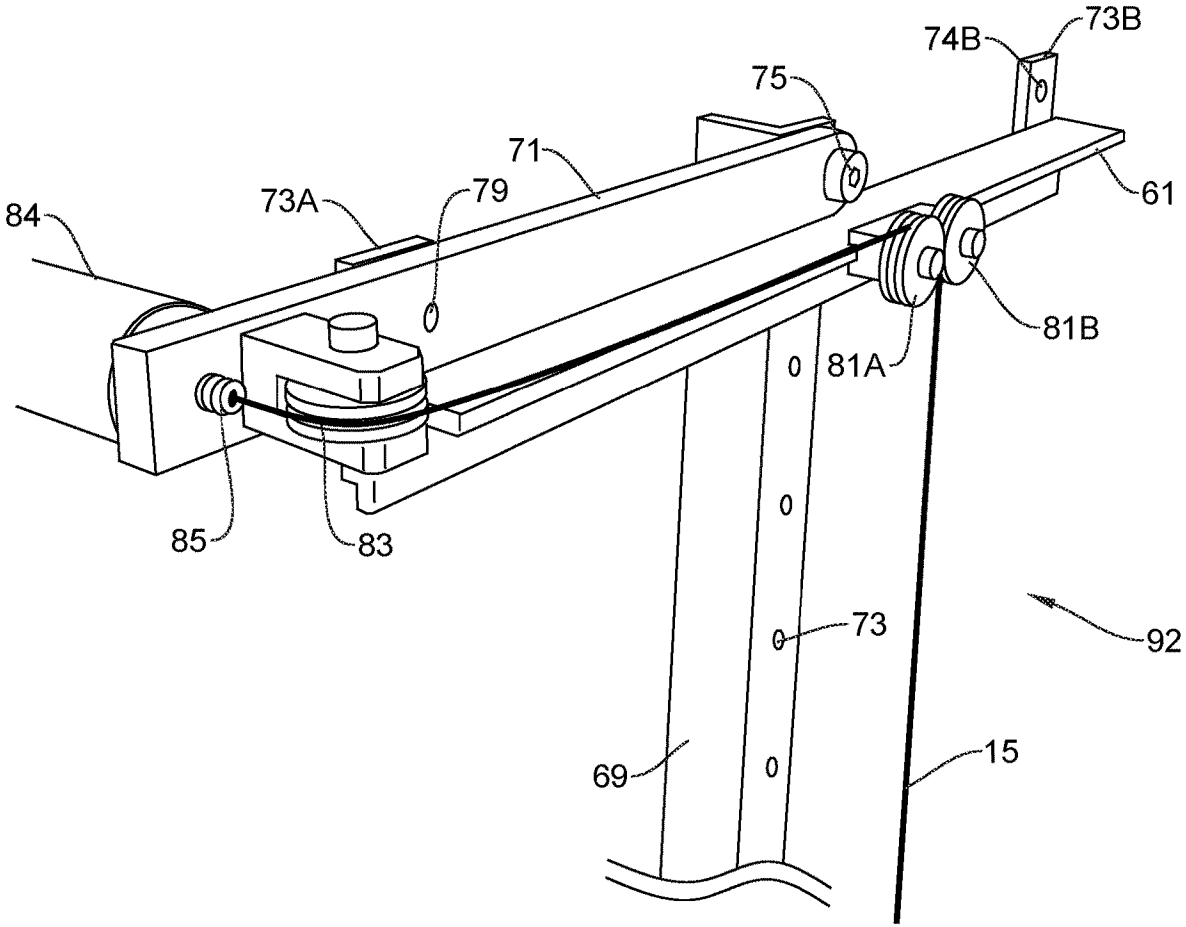
FIG. 9 is a perspective view of an upper portion of the swing practice apparatus of the present invention similar to that in FIG. 7, except that the trajectory wire is attached and engaged to wire guide pulleys.

FIG. 9 is a perspective view of the upper portion 92 of the swing practice apparatus 11 of the present invention similar to that shown in FIG. 7, except that the trajectory wire 15 runs through the horizontal arm wire guide pulleys 81A and 81B and hinged arm wire guide pulley 83. One end of the trajectory wire 15 is connected to the winding roller 37 (not shown in FIG. 9). The trajectory wire 15 from the winding roller 37 extends along the z-coordinate and pass through the grooves of the horizontal arm wire guide pulleys 81A and 81B. As shown, the trajectory wire 15 is sandwiched by the horizontal arm wire guide pulleys 81A and 81B that are arranged to be positioned along the horizontal arm 61. Both of the wire guide pulleys 81A and 81B rotate with axis in the direction from the pitcher's side to the catcher's side (y-axis). The trajectory wire 15 then runs along the x-axis and passes through the groove of the hinged arm wire guide pulley 83. The hinged arm wire guide pulley 83 rotates with z-axis (vertical direction). The trajectory wire 15 changes its direction at the hinged arm wire guide pulley 83 and enters into the trajectory wire hole 85, and runs along inside the trajectory pipe 21. The trajectory wire 15 then exits from the hole at the peak portion 24 of the trajectory pipe 21.

Figure 10A:
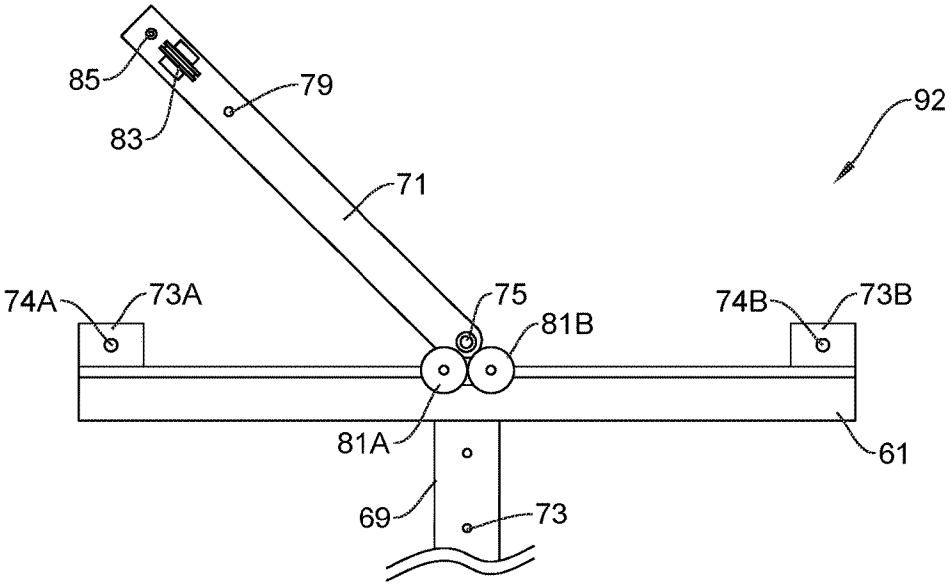
FIG. 10A is a front view illustrating the upper portion of the swing practice apparatus of the present invention wherein a hinged arm is being rotated at a hinged arm axis.

The swing practice apparatus 11 of the present invention can be easily adapted to a right-handed batter and a left-handed batter. The top view shown in FIG. 2 illustrates the situation wherein the user 101 is a right-handed batter. The swing practice apparatus 11 can be easily adjusted to the left-handed batter. FIG. 10A is a front view showing the upper portion 92 of the swing practice apparatus 11 of the present invention. The horizontal arm 61, the horizontal arm wire guide pulleys 81A and 81B, the notch 73A, the notch screw hole 74A, the notch 73B and the notch screw hole 74B as viewed from the front is symmetric. The hinged arm 71 is rotatable around the hinge pin 75 which functions as a rotational axis. As shown in FIG. 10A, the hinged arm 71 is being rotated. Assuming that the initial position of the hinged arm 71 as viewed from the front is leaned to the left as shown in FIG. 8B for the right-handed batter, the user is able to change the setting by rotating the hinged arm 71 to the position shown in FIG. 10B.

Figure 10B:
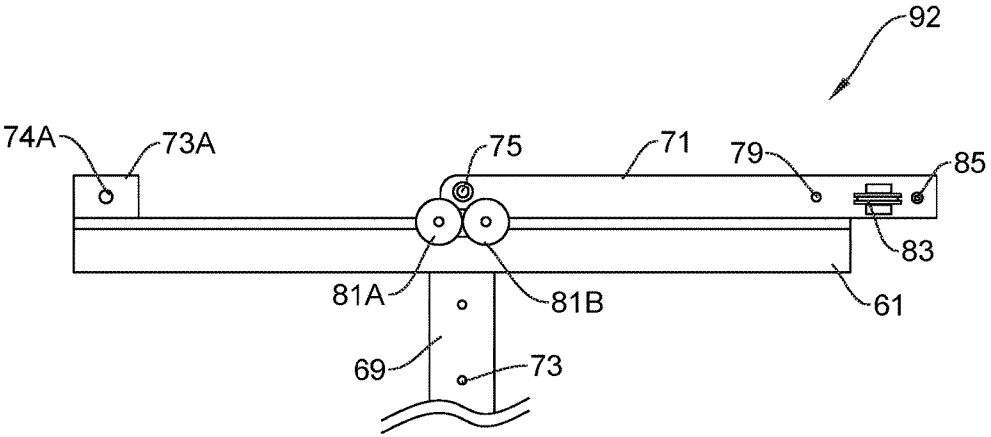
FIG. 10B is a front view illustrating the upper portion of the swing practice apparatus of the present invention wherein a hinged arm is positioned to the right.

As shown in FIG. 10B, the hinged arm 71 is rotated to the right to accommodate the left-handed batter. In other words, the hinged arm 71 is capable of 180 degree rotation around the hinge pin 75 which functions as a rotation axis. After the hinged arm 71 is rotated to the desired side, which is the right side in FIG. 10B, the user may insert a pin or a screw (not shown) to the arm fixture hole 79, which is aligned with the screw hole 74B, to securely fix the hinged arm 71 to the horizontal arm 61. The horizontal arm wire guide pulleys 81A and 81B allow the trajectory wire 15 to easily change its direction regardless of whether the hinged arm 71 is to be positioned on the right side or the left side. Thus, the user is able to adjust the position of the hinged arm 71 to accommodate either a right-handed batter or a left-handed batter. In changing the position of the hinged arm 71, it is not necessary to detach the trajectory wire 15 from the swing practice apparatus 11. The user simply needs to loosen the trajectory wire 15 by releasing the stopper 56 to rotate the hinged arm 71 to a desired side.

Figure 11B:
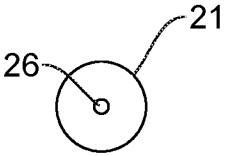
FIG. 11A to 11B are illustrations of an end of the trajectory pipe of the present invention.
Figure 11C:
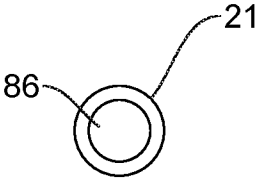
FIG. 11C is an illustration of the other end of the trajectory pipe of the present invention.
Figure 11A:
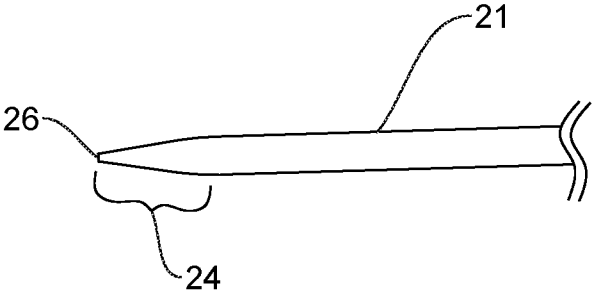

FIG. 11A is an illustration of the trajectory pipe 21 of the present invention which shows a magnified view near the peak portion 23. The trajectory pipe 21 has a peak portion 24. The terminal (distal) end of the peak portion 24 is provided with a small hole, which is referred to as a peak hole 26, for the trajectory wire 15 to pass through. The peak hole 26 is adapted to allow passage of the trajectory wire 15. The trajectory wire 15 that exits from the peak hole 26 of the peak portion 24 extends toward the bracing structure, such as the pole 9 shown in FIG. 1.

FIG. 11B is an illustration showing the trajectory pipe 21 of the present invention as viewed from the peak hole 26. FIG. 11C is an illustration showing the trajectory pipe 21 of the present invention as viewed from the opposite end of the peak portion 24, which is the attachment end of the trajectory pipe 21. The end hole 86 of the trajectory pipe 21 is contiguous to the the peak hole 26, and provides passageway for the trajectory wire 15. The trajectory wire 15 passing from the end hole 86 of the trajectory pipe 21 passes through the trajectory wire hole 85 of the hinged arm 71.

Figure 12A:
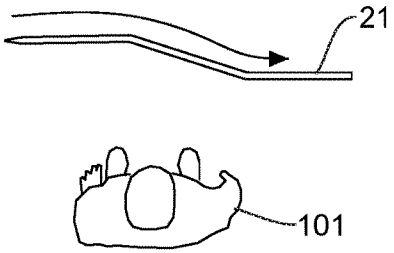
FIGS. 12A to 12F are illustrations showing the trajectory pipes in various configurations and a user using the swing practice apparatus of the present invention.
Figure 12B:
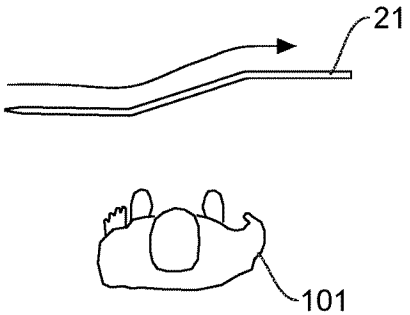

FIG. 12A and FIG. 12B are top views showing embodiment examples illustrating the arrangement of the trajectory pipe 21 in relation to the user 101. Since the inner circumference of the suspension ring 29 is large enough to pass through the the trajectory pipe 21, the baseball 3 suspended to the suspension ring 29 follows the trajectory of the trajectory pipe 21. Based on the placement of the trajectory pipe 21 and the user 101, many types of ball trajection can be simulated. In the case illustrated in FIG. 12A, the ball moves toward the user 101. In the case illustrated in FIG. 12B, the ball moves away from the user 101 as the ball approaches the user 101.

Figure 12C:
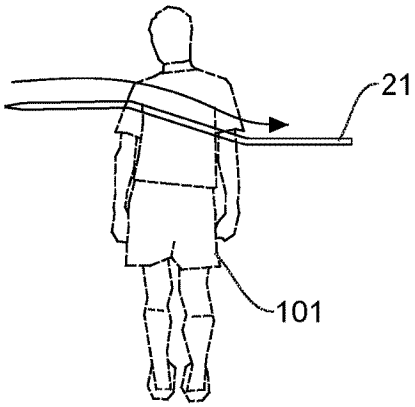
Figure 12D:
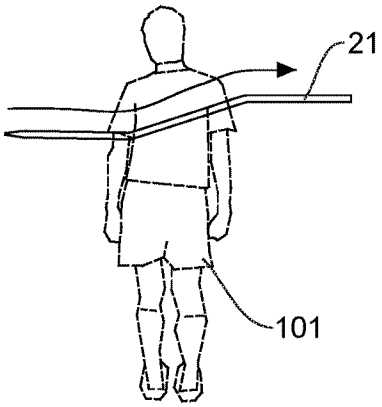
Figure 12F:
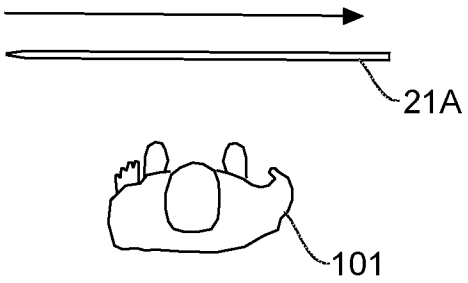
Figure 12E:
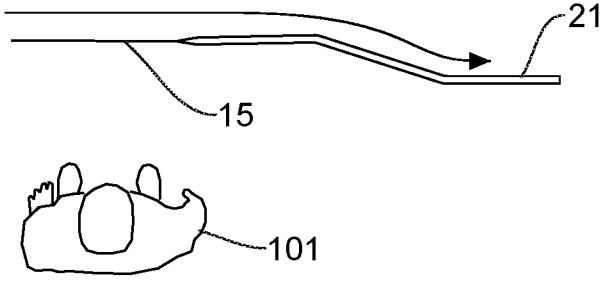

FIGS. 12C and 12D are side views showing the trajectory pipe 21 and the user 101. In the case illustrated in FIG. 12C, the ball drops as it approaches the user. In the case illustrated in FIG. 12D, the ball rises up as it approaches the user. FIG. 12E is a top view similar to that shown in FIG. 12A, except that the user 101 is positioned more toward the pitcher side. In case the user does not need a trajectory change of the baseball 3, the user 101 may simply change the position so that the user can hit the baseball 3 before it moves to the trajectory pipe. FIG. 12F shows a top view showing illustrating the trajectory pipe 21A which is configured to be straight. One skilled in the art would readily appreciate that the configuration of the trajectory pipe 21 for the swing practice apparatus can take many other forms to simulate desired types of ball trajectory.

Although the swing practice apparatus is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A swing practice apparatus comprising:

a base portion that makes a contact on a ground;

a winding roller having an attaching mechanism;

a trajectory wire, one end of which is connected to the attaching mechanism of the winding roller, and the other end of which is connected to a bracing structure;

a standing pole that extends upward vertically from the base portion;

a horizontal arm that is elongated between a first base side and a third base side and is arranged to be perpendicular to the standing pole;

a pair of horizontal arm wire guide pulleys, having grooves, attached side by side at a middle of the horizontal arm, to receive the trajectory wire in the grooves;

a hinged arm that is rotatable at one end by a hinge at a middle of the horizontal arm;

a hinged arm wire guide pulley attached at an end of the hinged arm opposite to the middle of the horizontal arm;

a trajectory wire hole formed at the end of the hinged arm where the hinged arm wire guide pulley is positioned, wherein the trajectory wire hole is adapted to allow passage of the trajectory wire;

a trajectory pipe, one end of which is connected to the hinged arm at the trajectory wire hole, and the other end is extended toward a pitcher side and has a peak hole at its terminal end adapted to allow passage of the trajectory wire; and a ball suspended to a suspension ring, wherein the suspension ring is slidable along the trajectory wire and the trajectory pipe.

2. The swing practice apparatus of claim 1, wherein the base portion comprises a base contact portion having a flat surface adopted to contact on a ground, and a prong portion provided at the bottom of the base contact portion and has a tapered end.

3. The swing practice apparatus of claim 1, further comprising:

a gear connected to the winding roller, having a plurality of teeth; and a stopper that has an end to engage with one of the plurality of teeth of the winding roller.

4. The swing practice apparatus of claim 3, further comprising:

a spring that exerts force to the stopper so that the end of the stopper is securely engaged to a tooth of the gear by being pushed toward the tooth.

5. The swing practice apparatus of claim 4, further comprising:

a handle attached to the gear for the user to manually rotate the gear and the winding roller to wind and unwind the trajectory wire.

6. The swing practice apparatus of claim 1, wherein the trajectory pipe has a curved portion that simulates a curve ball.

7. The swing practice apparatus of claim 1, wherein the trajectory pipe is straight.

8. The swing practice apparatus of claim 1, further comprising an upper portion comprised of:

a vertical bar connected to the horizontal arm and the hinged arm;

the horizontal arm that is attached perpendicularly to the vertical bar; and the hinged arm;

wherein the vertical bar is elongated vertically and has a plurality of fixing holes and the standing pole has plurality of positioning holes, and the fixing holes and the positioning holes are adapted to be connected by being inserted by a screw.

* * * * *